US009790430B2

(12) United States Patent
Holl

(10) Patent No.: US 9,790,430 B2
(45) Date of Patent: Oct. 17, 2017

(54) INSTALLATION FOR PRODUCING A COAL CAKE SUITABLE FOR COKING

(75) Inventor: Norbert Holl, Cologne (DE)

(73) Assignee: OUTOTEC OYJ, Espoo (FI)

( * ) Notice: Subject to any disclaimer, the term of this patent is extended or adjusted under 35 U.S.C. 154(b) by 1549 days.

(21) Appl. No.: 13/504,188

(22) PCT Filed: Oct. 20, 2010

(86) PCT No.: PCT/EP2010/006413

§ 371 (c)(1),
(2), (4) Date: Apr. 26, 2012

(87) PCT Pub. No.: WO2011/050918

PCT Pub. Date: May 5, 2011

(65) Prior Publication Data

US 2012/0211345 A1 Aug. 23, 2012

(30) Foreign Application Priority Data

Oct. 26, 2009 (DE) ..... 10 2009 050 731

(51) Int. Cl.
*C10B 45/02* (2006.01)
*C10B 31/00* (2006.01)
(Continued)

(52) U.S. Cl.
CPC ..... *C10B 45/02* (2013.01); *B30B 11/022* (2013.01); *C10B 31/08* (2013.01); *C10B 31/10* (2013.01); *C10B 31/00* (2013.01)

(58) Field of Classification Search
CPC ..... C10B 31/06; C10B 31/08; C10B 31/10; C10B 13/00; C10B 47/38; C10B 37/04; C10B 45/02; C10L 5/02
See application file for complete search history.

(56) References Cited

U.S. PATENT DOCUMENTS 722,151 A * 3/1903 Seaver ..... C10B 45/02 198/540
3,883,278 A * 5/1975 Hass ..... 425/135
(Continued)

FOREIGN PATENT DOCUMENTS

CN 1706914 A * 12/2005
CN 201052632 Y * 4/2008
(Continued)

OTHER PUBLICATIONS

English Abstract—CN 1706914 A.*
(Continued)

*Primary Examiner* — In Suk Bullock
*Assistant Examiner* — Jonathan Pilcher
(74) *Attorney, Agent, or Firm* — Leydig, Voit & Mayer, Ltd.

(57) ABSTRACT

A method for producing a coal cake that is suitable for coking and for subsequent charging of a coking oven chamber. At least one vibrating station including a push-table vibrating machine with an oscillatorily mounted vibrating table is provided. A mold box is clamped to the vibrating table. The mold box is filled with granular raw coal material. A weight is placed on top of the mold box. The mold box is vertically oscillated while the weight presses from above into the mold box so as to mold a vibration-compacted coal block. The vibration-compacted coal block is pushed off the vibrating table, using an ejector, onto an underlying support. The vibration-compacted coal block is pushed on the underlying support by a length (x) of the vibration-compacted coal block successive to another vibration-compacted coal block. The vibration-compacted coal blocks are successively stacked so as to form the coal cake. The coal cake is introduced into the coking oven chamber using a transporting device.

6 Claims, 1 Drawing Sheet

(51) Int. Cl.

| | |
|---|---|
| ***C10B 31/10*** | (2006.01) |
| ***B30B 11/02*** | (2006.01) |
| ***C10B 31/08*** | (2006.01) |

(56) References Cited

U.S. PATENT DOCUMENTS

| | | | | |
|---|---|---|---|---|
| 4,108,610 | A * | 8/1978 | Leibrock | C10B 45/02 100/209 |
| 4,606,876 | A * | 8/1986 | Yoshida | B30B 11/26 264/120 |
| 5,059,110 | A * | 10/1991 | Allison et al. | 425/260 |
| 6,290,494 | B1 | 9/2001 | Barkdoll | |
| 6,321,610 | B1 * | 11/2001 | Sekiguchi | 74/61 |
| 7,611,609 | B1 * | 11/2009 | Valia | C10B 31/10 201/20 |
| 8,888,960 | B2 * | 11/2014 | Kim | 201/6 |
| 2005/0012236 | A1 * | 1/2005 | Molin | 264/104 |
| 2008/0087538 | A1 | 4/2008 | Schuecker | |

FOREIGN PATENT DOCUMENTS

| | | | |
|---|---|---|---|
| DE | 292336 | C | 6/1916 |
| DE | 415846 | C | 7/1925 |
| DE | 3145344 | A1 | 5/1983 |
| DE | 3145344 | C2 | 9/1988 |
| DE | 102004056564 | A1 | 6/2006 |
| DE | 102005031188 | B3 | 1/2007 |
| JP | 57090091 | A | 6/1982 |
| JP | 57090092 | A | 6/1982 |
| JP | 58089685 | A | 5/1983 |
| WO | WO 2006063814 | A1 | 6/2006 |

OTHER PUBLICATIONS

English Abstract—CN 201052632 Y.*

European Patent Office, International Search Report in International Patent Application No. PCT/EP2010/006413 (Feb. 9, 2011).

"Anode vibrating compactor," Outotec GmbH, Cologne/Germany, 2007, p. 1-4.

* cited by examiner

INSTALLATION FOR PRODUCING A COAL CAKE SUITABLE FOR COKING

CROSS-REFERENCE TO PRIOR APPLICATIONS

This application is a U.S. National Phase application under 35 U.S.C. §371 of International Application No. PCT/EP2010/006413, filed on Oct. 20, 2010, and claims benefit to German Patent Application No. DE 10 2009 050 731.0, filed on Oct. 26, 2009. The International Application was published in English on May 5, 2011 as WO 2011/050918 under PCT Article 21(2).

FIELD

The invention relates to an installation for producing a coal cake that is suitable for coking and is created by using vibratory compaction, for the purpose of subsequent charging of a coking oven chamber.

BACKGROUND

In the production of coke, coal is heated and degassified in the chambers of a coking oven with the exclusion of air. To improve the quality of the coke, the coal is compacted to be coked into a coal cake, which is subsequently pushed into an empty coking oven chamber.

For compacting coal, mechanical stamping devices can be used, comprising a number of vertical stamper rods which are arranged next to one another, are distributed over the length of a stamping mould and carry plate-shaped stamper feet at the lower ends. When compacting, the stamper rods are raised by means of special lifting devices, for example pressed-on pairs of cam discs, and then allowed to fall freely, so that the bed of loose coal filled into the stamping mould is compacted by the stamper feet as with drop hammers.

DE 31 45 344 C discloses a stamping device in which it is not the potential energy of freely falling stampers that is used for compacting the coal, but vibrational energy transferred to the stamper feet by a vibrator respectively acting on the stamper rods. Here, too, the coking coal has to be successively compacted layer by layer, i.e. a bed of loose coal has to be introduced into the stamping mould and then subsequently compacted by stamping in alternating repetition in order to be able to create a coal cake with a density that is to some extent uniformly distributed over the length and width of the cake. For example, it has been necessary in stamping machines for five layers of coal 20 cm in height, for example, to be stamped successively, one on top of the other, in order to arrive at a height of the stamped coal cake of, for example, 1.0 m. Apart from this, the stamper feet hinder uniform filling of the stamping mould with coal material.

German Patent No. 292 336, issued on 2 Jun. 1916, describes to compact coal before coking not by stamping but by vibrating in a vibrating machine, which however is not specified there. This idea has not been taken up and put into practice by those skilled in the art. Instead, on the subject of vibratory compaction of coal to be coked, it has been proposed by DE 10 2005 031 188 B to introduce through holes in the top of a coking oven chamber a vibrator suspended from a cable as an active vibration element, which is intended to compact the loose coal filled into the oven chamber successively layer for layer. It is likely that implementation of this proposal will present difficulties, if only because it will not be easy to pull the vibrator out each time from a ready-vibration-compacted, solidified layer of coal, in particular if a binder is used.

Finally, with DE 10 2004 056 564 A, those skilled in the art turned completely away from the idea of vibratory compaction of coal to be coked, since not a vibrating machine but a hydraulic pressing device is proposed there, for producing a horizontally lying pressed coal cake for the purpose of subsequent coking.

SUMMARY

In an embodiment, the present invention provides a method for producing a coal cake that is suitable for coking and for subsequent charging of a coking oven chamber. At least one vibrating station including a push-table vibrating machine with an oscillatorily mounted vibrating table is provided. A mould box is clamped to the vibrating table. The mould box is filled with granular raw coal material. A weight is placed on top of the mould box. The mould box is vertically oscillated while the weight presses from above into the mould box so as to mould a vibration-compacted coal block. The vibration-compacted coal block is pushed off the vibrating table, using an ejector, onto an underlying support. The vibration-compacted coal block is pushed on the underlying support by a length (x) of the vibration-compacted coal block successive to another vibration-compacted coal block. The vibration-compacted coal blocks are stacked so as to form the coal cake. The coal cake is introduced into the coking oven chamber using a transporting device.

BRIEF DESCRIPTION OF THE DRAWINGS

The present invention will be described in even greater detail below based on the exemplary schematic figures. The invention is not limited to the exemplary embodiments. Features described and/or represented in the various figures can be used alone or combined in embodiments of the present invention. Other features and advantages of various embodiments of the present invention will become apparent by reading the following detailed description with reference to the attached drawings which illustrate the following.

DETAILED DESCRIPTION

Figure 1:
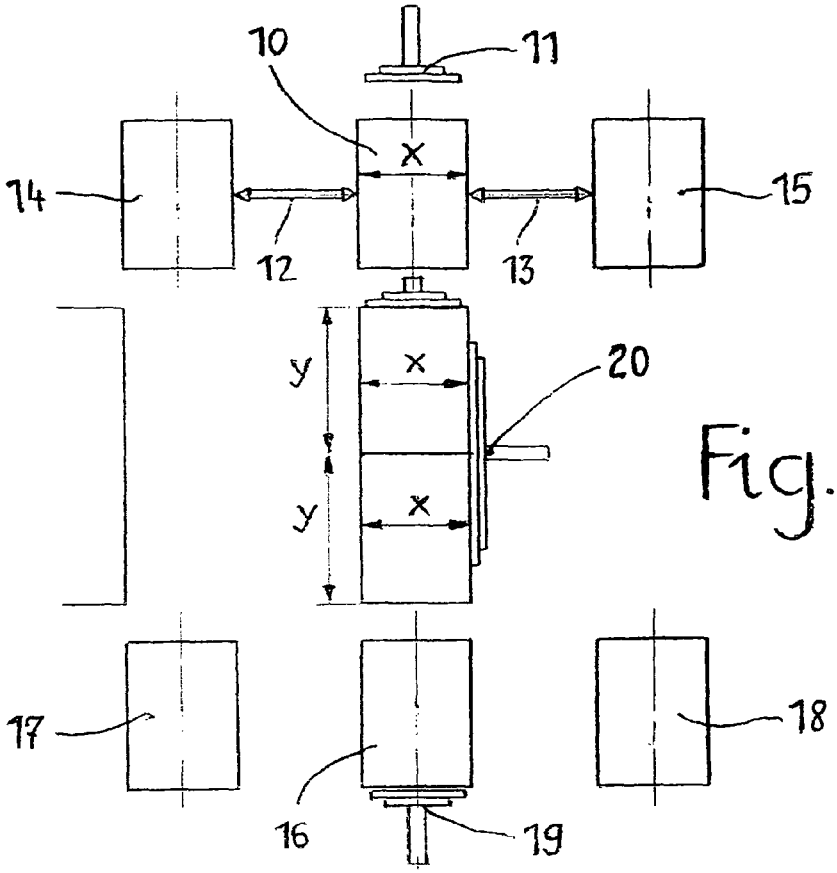
FIG. 1 shows in plan view the installation according to an embodiment of the invention for producing a coal cake suitable for coking, for the purpose of subsequent charging of a coking oven chamber.

In an embodiment, the present invention provides an installation for producing a coal cake suitable for coking which can in principle have any desired formats, but in particular also very large formats adapted to large-format coking oven chambers, and which nevertheless has a high density that is distributed as uniformly as possible over the length and width of the cake, to be precise using the efficient and operationally reliable process of vibratory compaction and without having to use stamping devices, which are susceptible to wear and do not allow high throughputs.

According to an embodiment of the invention, to produce the coal cake, at least one push-table vibrating machine is used, on the vibrating table of which a mould box can be clamped and, after filling with a batch of the raw coal material, a weight placed on top. In the space between the upper side of the vibrating table and the underside of the weight on top, the raw coal material is moulded by vibratory compaction into a coal block of a specific density and height. After raising the mould box, which is usually of a rectangular cross section, the correspondingly cuboidal vibration-compacted coal block is pushed off from the vibrating table by means of an ejector.

During the operation of the vibrating machine, i.e. during the operation of the oscillating drive, such as for example an unbalanced drive, that is connected to the vibrating table, the raw coal material to be compacted is made to perform vertical oscillations in the mould box, while the weight on top is pressed from above into the mould box, onto the coal material. The vertical vibrations cause the weight on top to be repeatedly lifted off from the surface of the coal block that is being compacted and to press onto the upper side of the coal block with a specific impact frequency and impact intensity. Therefore, according to an embodiment of the invention, the compaction of the raw coal material takes place by a combination of both vibrating and at the same time stamping, making a particularly high output of uniformly highly compacted coal blocks or high output of coal cakes possible, suitable for then being coked in the coking oven to form a very uniform coke of a correspondingly high quality.

The coal blocks successively vibration-compacted according to an embodiment of the invention can be stacked next to one another and/or one on top of the other, and, using a transporting device such as movable pallets, a lifting device etc., a coal cake suitable for coking, of any desired format, for example with a format length of 14.0 m, a width of 4.0 m, a height of 1.3 to about 1.45 m, and suitable for charging a correspondingly large horizontal-chamber coking oven, can be put together from a multiplicity of vibration-compacted cuboidal coal blocks.

The individual coal blocks of the coal cake must each have the same dimensions, in particular the same height and the same density. This requirement is met by the use provided according to an embodiment of the invention of at least one push-table vibrating machine, which together with peripheral equipment has proven successful over decades as an operationally reliable device in a quite different branch of technology, that is in the moulding of anodes and/or cathodes from a hot mixture of petroleum coke and pitch, in order for such vibration-compacted anodes/cathodes to be used to allow metallic aluminium to be produced by smelting flux electrolysis in electrolysis cells, see for example the brochure "Anode vibrating compactor" of the company Outotec GmbH, Cologne/Germany, 2007.

If the installation according to an embodiment of the invention for producing a vibration-compacted coal cake has to introduce it into a horizontal-chamber coking oven, then, according to a further feature of an embodiment of the invention, a stack pusher can push the coal cake, put together from a multiplicity of vibration-compacted coal blocks, laterally into the corresponding coking oven chamber. However, it would also be possible, in particular in the case of a vertical-chamber coking oven, to introduce a coal cake comprising a multiplicity of vibration-compacted coal blocks stacked one on top of the other into the corresponding coking oven chamber from above by using a lifting device.

To increase the capacity of the installation according to an embodiment of the invention, expressed for example by the number of vibration-compacted coal blocks produced per unit of time, a raw material filling station may be provided on both sides of the vibrating table of the push-table vibrating machine, the vibrating table with the clamped-on mould box being able to travel back and forth between both opposing filling stations, i.e. while the mould box is being filled with a batch of raw coal material at one filling station, the next charge for filling the mould box is already being prepared at the other filling station.

In the case of the vibrating machine installation according to an embodiment of the invention, the respectively ready-vibration-compacted coal block is pushed from the vibrating table onto an underlying support such as a pallet by means of an ejector, to be precise in a direction transverse to the travelling movement of the vibrating table, after which the stack pusher pushes the coal block further on its underlying support by at least the length of the coal block in the direction of the coking oven chamber to be charged.

To increase the capacity of the installation according to an embodiment of the invention still further, the machine unit comprising the vibrating station with the two opposing filling stations may have a further machine unit arranged opposite it as a mirror image on the other side of the underlying support such as a pallet that receives the coal blocks, i.e. there are a total of two vibrating stations and four filling stations, the operating cycle of which may be synchronously controlled. With such an, as it were, double-tandem vibrating installation, the number of vibration-compacted coal blocks that can be moulded per unit of time can be doubled, and consequently very large widths of the coal cake put together from the individual blocks are also possible.

The installation according to FIG. 1 has a first machine unit, with a first vibrating station 10, which has an oscillatorily mounted vibrating table which is connected to an oscillating drive and onto which a generally rectangular mould box can be clamped, in which, after filling with a batch of raw coal material to be compacted, a weight can be placed on top. The mould box, which is open at the top and bottom, has a length x of, for example, 1.4 m and a width y of, for example, 2.0 m. After moulding, and once the mould box has been raised, the cuboidal 1.4 m long and 2.0 m wide, and for example 1.45 m high, coal block that has been vibration-compacted between the vibrating table and the weight on top is pushed onto an underlying support such as a pallet, to be precise by means of an ejector 11, the direction of movement of which is perpendicular to the pushing path 12, 13 of the pushing table of the vibrating machine.

Arranged on each of both sides of the vibrating table of the vibrating station 10 is a raw material filling station 14, 15, the vibrating table with the clamped-on mould box being able to travel back and forth between the two filling stations 14, 15, i.e. while the mould box is being filled with a batch of raw coal material at the filling station 14, the next batch for filling the mould box is already being prepared at the other filling station 15.

According to the exemplary embodiment of FIG. 1, the first machine unit comprising the first vibrating station 10 with the two opposing filling stations 14, 15 has a second machine unit arranged opposite it as a mirror image on the other side of the underlying support that receives the moulded coal blocks, so that then there are a total of two vibrating stations 10 and 16 and four filling stations 14, 15 and 17, 18. The coal block ejector for the vibrating station 16 is indicated by 19. It can be seen that the two ejectors 11 and 19 in each case push together a ready-vibration-compacted coal block of the length x and width y to form a pair of blocks, which then produces a block format x=1.4 m and 2 times y=4.0 m. This pair of coal blocks is then pushed at one and the same time by a stack pusher 20 further in the direction of the coking oven chamber to be charged by at least the length x of the pair of blocks, and space is made for a new pair of vibration-compacted coal blocks.

Figure 2:
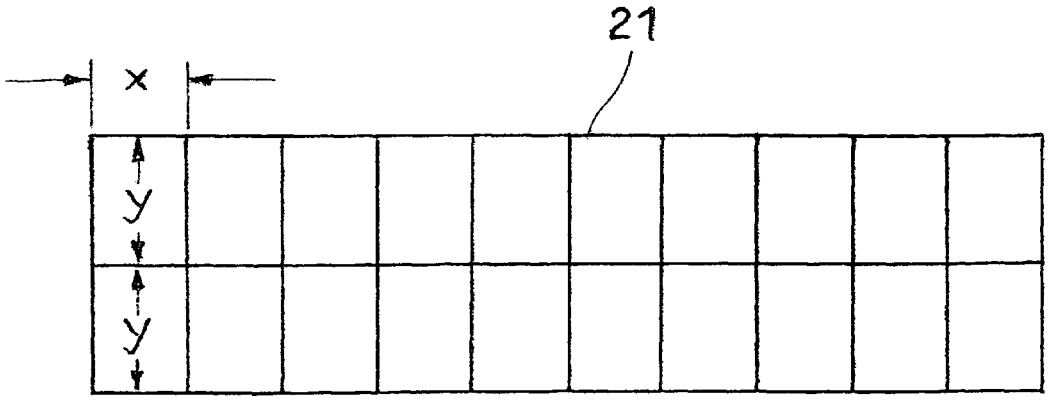
FIG. 2 shows on a somewhat reduced scale the plan view of a coal cake put together from a total of 20 vibration-compacted coal blocks that have each been produced in the installation according to FIG. 1.

FIG. 2 shows in plan view the coal cake 21, which has been pushed together from ten pairs of vibration-compacted coal blocks produced in the installation of FIG. 1, each of the length x=1.4 m and width y=2.0 m, i.e. the coal cake 21 which has been put together from a total of 2 times 10=20 coal blocks and is intended to be pushed into an empty coking oven chamber then has a format with a length of 14 m, a width of 4.0 m and a height or thickness of 1.45 m, and it has a density, distributed uniformly over the length and width of the coal cake, of, for example, greater than 1.14 $t/m^3$.

The natural moisture contained in the granular raw coal material of about 6% may suffice as a binder to give the coal blocks that are to be moulded by vibratory compaction sufficiently great stability. However, there is also the possibility of admixing with the raw coal materials that are to be compacted their own suitable binder, such as for example pitch. Finally, there is also the possibility of preparing the raw coal materials that are to be compacted and possibly a binder as a hot mixture and then moulding this mixture in the vibrating machine or machines to form very stable coal blocks.

While the invention has been described with reference to particular embodiments thereof, it will be understood by those having ordinary skill the art that various changes may be made therein without departing from the scope and spirit of the invention. Further, the present invention is not limited to the embodiments described herein; reference should be had to the appended claims.

The invention claimed is:

1. A method for producing a coal cake that is suitable for coking and for subsequent charging of a coking oven chamber, the method comprising:

providing:

a first vibrating device including a first push-table vibrating machine having an oscillatorily mounted first vibrating table movable along a first vibrating table pushing path, the first vibrating table having a first mould box disposed thereon, the first vibrating device being disposed in a middle of the first vibrating table pushing path, the first vibrating device having first and second raw material filling devices disposed on opposite sides thereof, the first vibrating table being configured to move along the first vibrating table pushing path between the first and second raw material filling devices; and a second vibrating device including a second push-table vibrating machine having an oscillatorily mounted second vibrating table movable along a second vibrating table pushing path, the second vibrating table having a second mould box disposed thereon, the second vibrating device being disposed in a middle of the second vibrating table pushing path, the second vibrating device having third and fourth raw material filling devices disposed on opposite sides thereof, the second vibrating table being configured to move along the second vibrating table pushing path between the third and fourth raw material filling devices, the second vibrating device and the third and fourth raw material filling devices being disposed opposite to the first vibrating device and the first and second raw material filling devices with respect to the underlying support;

filling each of the first and second mould boxes with granular raw coal material;

placing a weight on top of each of the first and second mould box boxes;

vertically oscillating each of the first and second mould boxes while the weights press from above into the mould boxes so as to mould first and second vibration-compacted coal blocks, the vertically oscillating being performed such that the weights are repeatedly lifted off from a surface of the coal blocks with a predetermined frequency and intensity;

pushing, by a first ejector, the first vibration-compacted coal block off the first vibrating table onto an underlying support;

pushing, by a second ejector, the second vibration-compacted coal block off the second vibrating table onto the underlying support;

pushing the first and second vibration-compacted coal blocks on the underlying support by a length (x) of the vibration-compacted coal blocks successive to other vibration-compacted coal blocks;

stacking the vibration-compacted coal blocks so as to form the coal cake; and introducing, by a transporting device, the coal cake into the coking oven chamber.

2. The method according to claim 1, wherein the underlying support is a pallet.

3. The method according to claim 1, wherein the transporting device includes a stack pusher configured to push the coal cake laterally into the coking oven chamber.

4. The method according to claim 1, wherein the transporting device includes a lifting device configured to introduce the coal cake into the coking oven chamber from above.

5. An apparatus for producing a coal cake that is suitable for coking and for subsequent charging of a coking oven chamber, the apparatus comprising:

a first vibrating device including a first push-table vibrating machine having an oscillatorily mounted first vibrating table movable along a first vibrating table pushing path, the first vibrating table having a first mould box disposed thereon and a first weight disposed on top of the first mould box for pressing from above into the first mould box, the first vibrating device being disposed in a middle of the first vibrating table pushing path, the first vibrating device having first and second raw material filling stations disposed on opposite sides thereof, the first vibrating table being configured to move along the first vibrating table pushing path between the first and second raw material filling devices, a first ejector being movable in a first direction perpendicular to the first vibrating table pushing path and configured to push a first vibration-compacted coal block from the first vibrating table onto an underlying support;

a second vibrating device including a second push-table vibrating machine having an oscillatorily mounted second vibrating table movable along a second vibrating table pushing path, the second vibrating table having a second mould box disposed thereon and a second weight disposed on top of the second mould box for pressing from above into the second mould box, the second vibrating device being disposed in a middle of the second vibrating table pushing path, the second vibrating device having third and fourth raw material filling devices disposed on opposite sides thereof, the second vibrating table being configured to move along the second vibrating table pushing path between the third and fourth raw material filling devices, a second ejector being movable in a second direction perpendicular to the second vibrating table pushing path and configured to push a second vibration-compacted coal block from the second vibrating table onto the underlying support, the second vibrating device and the third and fourth raw material filling devices being disposed opposite to the first vibrating device and the first and second raw material filling devices with respect to the underlying support; and a transporting device including a stack pusher movable in a third direction parallel to the first and second vibrating table pushing paths, the transporting device being configured to push the first and second vibration-compacted coal blocks on the underlying support by a length (x) of the vibration-compacted coal blocks and to stack the vibration-compacted coal blocks, wherein operating cycles of the first and second vibrating devices are synchronously controllable, and wherein the first and second vibrating tables are each driven by an oscillating drive configured to vertically oscillate the tables such that the weights are repeatedly lifted off from a surface of the coal blocks with a predetermined frequency and intensity.

6. The apparatus according to claim 5, wherein the underlying support includes a pallet.

* * * * *